US011419404B2

(12) United States Patent
Jacob et al.

(10) Patent No.: US 11,419,404 B2
(45) Date of Patent: Aug. 23, 2022

(54) PACKAGING AND DISTRIBUTION ASSEMBLY FOR A TWO-COMPONENT FLUID PRODUCT

(71) Applicant: L'OREAL, Paris (FR)

(72) Inventors: Joris Jacob, Clichy (FR); Soukai Diouf, Clichy (FR); Antoine Sabattini, Clichy (FR); Christophe Ribault, Clichy (FR)

(73) Assignee: L'OREAL, Paris (FR)

( * ) Notice: Subject to any disclaimer, the term of this patent is extended or adjusted under 35 U.S.C. 154(b) by 507 days.

(21) Appl. No.: 16/604,620

(22) PCT Filed: Apr. 13, 2018

(86) PCT No.: PCT/EP2018/059598
§ 371 (c)(1),
(2) Date: Oct. 11, 2019

(87) PCT Pub. No.: WO2018/189395
PCT Pub. Date: Oct. 18, 2018

(65) Prior Publication Data

US 2021/0112945 A1 Apr. 22, 2021

(30) Foreign Application Priority Data

Apr. 14, 2017 (FR) ..... 17 53309

(51) Int. Cl.
*B65D 51/28* (2006.01)
*A45D 34/04* (2006.01)
*B65D 47/18* (2006.01)

(52) U.S. Cl.
CPC ..... *A45D 34/04* (2013.01); *B65D 51/2842* (2013.01); *A45D 2200/058* (2013.01); *B65D 47/18* (2013.01)

(58) Field of Classification Search
CPC ..... A45D 34/04; A45D 2200/058; B65D 51/2842; B65D 47/18; B01L 3/0282
(Continued)

(56) References Cited

U.S. PATENT DOCUMENTS 1,843,812 A * 2/1932 Dykema ..... B01L 3/0282 422/934
3,347,410 A * 10/1967 Schwartzman .... B65D 81/3222 222/129

(Continued)

FOREIGN PATENT DOCUMENTS

CN 103201191 A 7/2013
DE 10 2010 037 133 A1 3/2012

(Continued)

*Primary Examiner* — Paul R Durand
*Assistant Examiner* — Michael J. Melaragno
(74) *Attorney, Agent, or Firm* — Polsinelli PC

(57) ABSTRACT

This invention relates to a packaging and distribution assembly (10) for a fluid product, comprising: a receptacle for a first fluid composition; a storage member (22), comprising a tubular reservoir (40) for a second fluid composition, a closed end (48) of said tubular reservoir being configured to be arranged inside the receptacle assembled to said storage member; and a pressurization member (24) of the tubular reservoir. The storage member and the pressurization member comprise respectively a first (44) and second (84) sealing skirts, configured to be inserted one in the other in a sealed manner, in such a way as to define a closed chamber (130) in communication with the tubular reservoir (40), to be displaced axially one in relation to the other in such a way as to decrease the volume of said closed chamber.

20 Claims, 5 Drawing Sheets

(58) Field of Classification Search
USPC ..... 222/240
See application file for complete search history.

(56) References Cited

U.S. PATENT DOCUMENTS

| | | | | |
|---|---|---|---|---|
| 3,603,469 | A * | 9/1971 | Magni | B65D 51/285 215/DIG. 8 |
| 3,768,697 | A * | 10/1973 | Lerner | B67B 7/26 222/80 |
| 4,195,731 | A * | 4/1980 | Cavazza | B65D 81/3222 366/602 |
| 4,201,316 | A * | 5/1980 | Klingaman | B65D 81/3222 222/80 |
| 4,221,291 | A * | 9/1980 | Hunt | B65D 81/3222 426/115 |
| 6,305,576 | B1 * | 10/2001 | Leoncavallo | B65D 51/2814 222/88 |
| 9,993,060 | B2 * | 6/2018 | Hwang | A45D 34/06 |
| 11,083,275 | B2 * | 8/2021 | Jacob | A45D 34/045 |
| 2009/0301904 | A1 | 12/2009 | Bullard et al. | |
| 2013/0192713 | A1 * | 8/2013 | Drugeon | B65D 51/32 141/26 |
| 2014/0020789 | A1 * | 1/2014 | Duquet | B65D 47/18 141/24 |
| 2015/0016208 | A1 | 1/2015 | Larson et al. | |
| 2015/0175337 | A1 | 6/2015 | Lee | |
| 2016/0166046 | A1 * | 6/2016 | Hwang | A45D 34/06 206/221 |
| 2017/0181525 | A1 * | 6/2017 | Hwang | B01F 33/50111 |
| 2017/0231365 | A1 * | 8/2017 | Choi | A45D 34/04 222/383.1 |
| 2018/0042363 | A1 * | 2/2018 | Kim | A45D 40/265 |
| 2019/0029401 | A1 * | 1/2019 | Kim | A45D 34/00 |
| 2020/0154851 | A1 * | 5/2020 | Jacob | B65D 25/08 |
| 2021/0206542 | A1 * | 7/2021 | Kim | A45D 34/00 |
| 2021/0251366 | A1 * | 8/2021 | Zhong | B01L 3/0282 |
| 2022/0024673 | A1 * | 1/2022 | Silver | B65D 81/3222 |
| 2022/0041347 | A1 * | 2/2022 | Skillin | B65D 47/0809 |
| 2022/0105524 | A1 * | 4/2022 | Greiner-Perth | B65D 47/2068 |

FOREIGN PATENT DOCUMENTS

| | | | | |
|---|---|---|---|---|
| JP | H 04 7430 | U | 1/1992 | |
| JP | H 07 223644 | A | 8/1995 | |
| JP | H 11 208735 | A | 8/1999 | |
| KR | 2011-0133700 | A | 12/2011 | |
| KR | 2016-0106463 | A | 9/2016 | |
| WO | WO 2011/154397 | A1 | 12/2011 | |
| WO | WO-2017127992 | A1 * | 8/2017 | A45D 34/00 |
| WO | WO-2018002521 | A1 * | 1/2018 | |
| WO | WO-2018189241 | A1 * | 10/2018 | A45D 34/00 |
| WO | WO-2018189395 | A1 * | 10/2018 | A45D 34/00 |
| WO | WO-2020206948 | A1 * | 10/2020 | A45D 34/04 |
| WO | WO-2022033705 | A1 * | 2/2022 | |

* cited by examiner

PACKAGING AND DISTRIBUTION ASSEMBLY FOR A TWO-COMPONENT FLUID PRODUCT

CROSS REFERENCE TO RELATED APPLICATIONS

This application is a National Phase filing under 35 U.S.C. § 371 of PCT/EP2018/059598 filed on 13 Apr. 2018; which application in turn claims priority to Application No. 17 53309 filed in France on 14 Apr. 2017. The entire contents of each application are hereby incorporated by reference.

This invention relates to a packaging and distribution assembly for a fluid product, of the type comprising: a receptacle able to receive a first fluid composition, said receptacle comprising an opening provided with first removable means of assembly; a storage member, comprising: second removable means of assembly, able to cooperate with the first removable means of assembly to close the receptacle; and a tubular reservoir, integral with said second removable means of assembly and able to receive a second fluid composition, said tubular reservoir comprising a closed end, configured to be arranged inside the receptacle in an assembled configuration of said receptacle with said storage member; and a pressurization member of the tubular reservoir.

The term "fluid product" or "fluid composition" means a product or a composition that can flow under the action of gravity. Such a product or such a composition has for example the form of a liquid, a cream, a gel or a powder.

The invention in particular applies to the packaging and distribution of cosmetic products. The term "cosmetic product", refers, according to this invention, to a product as defined in Regulation (EC) No 1223/2009 of the European Parliament and of the Council of Nov. 30, 2009, on cosmetic products.

The invention applies more particularly to a packaging assembly configured to contain in isolation two separate fluid compositions before the first use, with these two compositions intended to be mixed. Such assemblies are in particular known from application PCT/CN2016/072042, not published to date, in the name of the Applicant.

The decrease in the volume of the closed chamber has for purpose to create an overpressure in the reservoir, in order to favor the later expulsion of the second composition outside said reservoir. In order to obtain such an overpressure, the closed chamber must be sealed to air while still having a variable volume.

Due to the number of parts forming the closed chamber of the device described in application PCT/CN2016/072042, the seal to the air is however difficult to obtain. Moreover the device described in the application hereinabove implements a bellows in order to create an overpressure in the reservoir which has a certain number of disadvantages, in particular in terms of assembly complexity, the number of parts implemented and the associated costs.

This invention has for purpose to propose a device with improved seal, having a limited number of parts and provided with a reliable and economic system for creating overpressure.

To this effect, the invention has for object a packaging and distribution assembly of the aforementioned type, wherein the storage member and the pressurization member respectively comprise a first and second sealing skirt, said first and second sealing skirts being configured pour to be inserted one in the other in a sealed manner, in such a way as to define a closed chamber in communication with the tubular reservoir, and to be displaced axially one in relation to the other in such a way as to decrease a volume of said closed chamber.

According to further advantageous aspects of the invention, the packaging and distribution assembly comprises one or several of the following features taken in isolation or in any technically possible combination:

- the storage member and pressurization member comprise respectively first and second means for guiding for a helical displacement of said pressurization member with respect to said storage member, said helical displacement being able to decrease a volume of the closed chamber. An advantage of this characteristic is that the displacement requires an effort that is less substantial than a guiding in simple translation;
- the storage member and pressurization member comprise respectively the first and second means of elastic fitting, able to block said storage and pressurization members in a compact configuration corresponding to a minimum volume of the closed chamber. An advantage of this characteristic is that the storage and pressurization members can be manipulated in an integral manner after blocking;
- the pressurization member comprises a striker of elongated shape, able to be received in the tubular reservoir of the storage member, said striker being configured in such a way that, in a deployed configuration of the storage and pressurization members, corresponding to a maximum volume of the closed chamber, an end face of said striker is arranged at a distance from the closed end of said tubular reservoir, said end face being able to strike said closed end during or at the end of the axial displacement of the first and second sealing skirts with respect to one another;
- in the compact configuration of the storage and pressurization members, the end face of the striker forms an axial protrusion with respect to the tubular reservoir;
- a lateral surface of the striker comprises at least one spline ending at the end face, in such a way as to facilitate a flow of the second fluid composition;
- a transversal section of the striker comprises a first and a second adjoining portions, with each one of said portions formed from a portion of disk having respectively a first and a second different radii of curvature, with a junction between said first and second portions defining the at least one spline of the lateral surface. An advantage of this characteristic is the better rate of restitution obtained, associated with an optimal flow of the second fluid composition;
- the packaging and distribution assembly further comprises a sampling member able to sample and/or distribute a dose of fluid composition received in the receptacle, said sampling member comprising third removable means of assembly, able to cooperate with the first removable means of assembly of the opening of the receptacle. An advantage of this characteristic is to allow the consumer to sample and use product doses coming from the mixture, intimate or phased, of the first and second fluid compositions.

The invention further relates to a method for using a packaging and distribution assembly such as described hereinabove, including the following steps: mounting of the storage member and of the receptacle in assembled configuration, the receptacle and the tubular reservoir respectively receiving the first and the second fluid compositions; then mounting of the storage member and of the pressurization member in deployed configuration; then axial displacement of the pressurization member with respect to the storage member in such a way as to reduce the volume of the closed chamber; then percussion of the closed end of the reservoir by the end face of the striker and expulsion under pressure of the second fluid composition into the first fluid composition.

According to an embodiment of the invention, the method then comprising the following steps: disassembly of the storage member and of the receptacle; then removable assembly of the sampling member with the receptacle.

The invention will be easier to understand in view of the following description, provided solely as a non-restricted example and with reference to the drawings, wherein:

FIG. 1 shows a packaging and distribution assembly 10 for a fluid product. Said fluid product, preferably liquid, is in particular a cosmetic product such as a cream or a serum for skin care, or a foundation.

In particular, before the marketing thereof, the fluid product is in form of a first 12 and a second 14 composition that are separate. Each one of the first 12 and second 14 compositions is preferably liquid, but can also have the form of a cream, gel, or powder.

The first composition 12 is for example a care serum base and the second composition 14 is for example a catalyst in concentrated form.

Preferably, the first composition 12 is transparent or translucent. Preferably, the second composition 14 is colored and/or visually different from the first composition 12.

Figure 10:
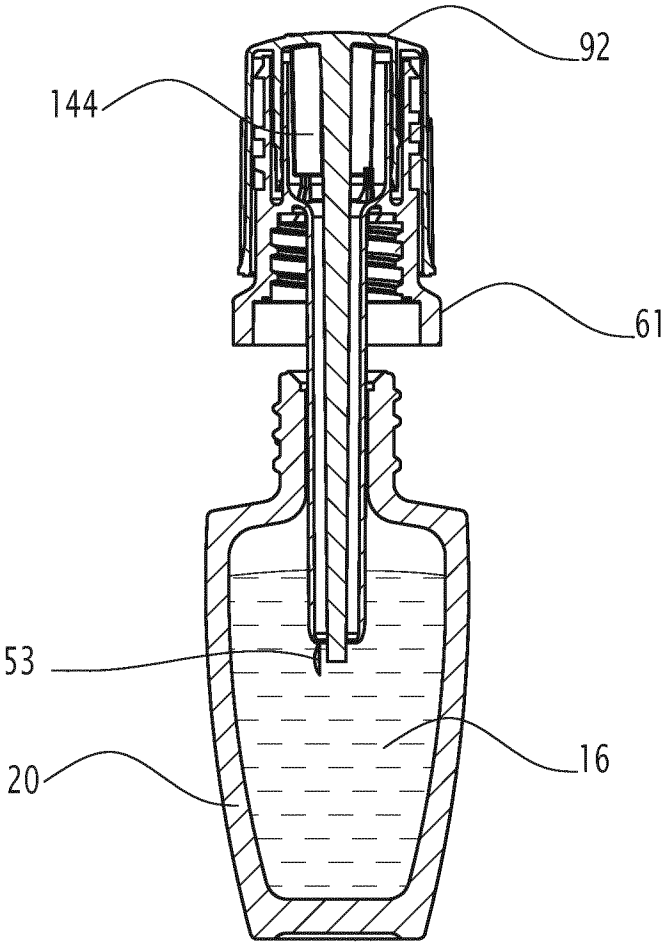

As shall be described hereinbelow, the first 12 and second 14 compositions are intended to be mixed by the user, in order to form a third composition 16 (FIG. 10).

The assembly 10 comprises in particular a receptacle 20, a storage member 22 and a pressurization member 24, shown as a longitudinal cross-section in 1. Preferably, the assembly 10 further comprises a distribution member 26.

Preferably, the receptacle 20 is at least partially formed of a transparent material such as glass. Said receptacle 20 comprises a first internal volume 28 able to receive the first composition 12, then the third composition 16 after the mixing with the second composition 14. The receptacle 20 further comprises a base 29, able to be placed on a horizontal surface.

The receptacle 20 further comprises an opening 30, opposite the base 29 and giving access to the internal volume 28. The opening 30 is materialized by a neck 32 extending along a first axis 34. The neck 32 is provided with a first removable means of assembly 36, such as a threading.

The storage member 22 extends along a second axis 38 and comprises a reservoir 40, a sleeve 42 and a first sealing skirt 44.

The reservoir 40 has a tubular shape extending along the second axis 38, between a first 46 and a second 48 end.

The first end 46 is open, giving access to a second internal volume 50. Said second internal volume is able to receive the second composition 14.

Figure 1:
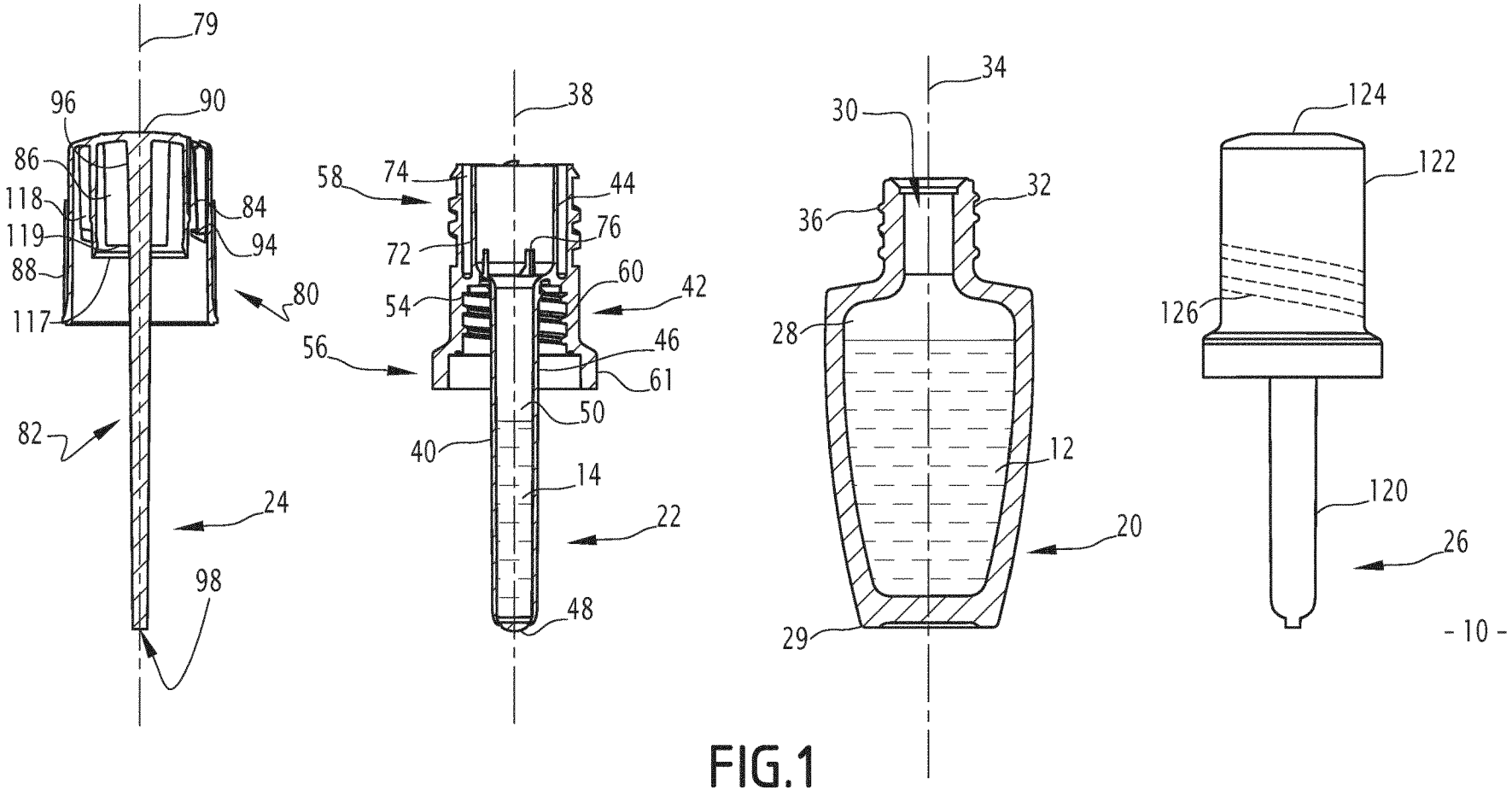
FIG. 1 is a view of a dissociated configuration of a packaging assembly according to an embodiment of the invention.
Figure 2:
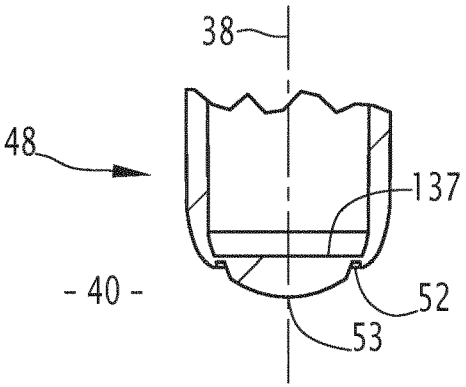

FIG. 2 shows a detailed view of the second end 48 of the reservoir 40. Said second end is closed in an initial state of the assembly 10, such as shown in FIGS. 1 and 2. The second end 48 comprises a first frangible zone, materialized by a circular groove 52 formed in a wall of the said second end 48. The circular groove 52 is centered on the second axis 38 and surrounds a closing pellet 53.

According to an advantageous embodiment, and such as shown in the figures, the closing pellet 53 has a profile such that its maximum thickness is greater, for example equal to at least 1.5 times, preferable equal to at least 2 times, the thickness of the wall of the second end 48 on the frangible zone materialized by the groove 52.

In particular, in the embodiment shown and which can be seen in particular in FIG. 2, the closing pellet 53 has a rounded profile, with a maximum thickness at the center.

Thanks to these provisions, and as shall be described hereinbelow, the tip 98 of the striker is prevented from passing through the closing pellet 53 and a detaching, total or partial of this pellet 53 is favored along the circular groove 52 under the effect of the axial force exerted by the striker. The dimensioning of these thicknesses will be adapted to the material used to carry out the second end 48 and the reservoir 40.

According to an embodiment, the circular groove 52 is not closed. More precisely, said groove extends over an angular portion less than 360° and for example between 270° and 330°, in order to provide a hinge, in particular formed by an extra thickness of material, between the closing pellet 53 and the rest of the reservoir 40.

In the embodiment shown, the reservoir 40 is formed from one piece. In an alternative not shown, the second end and/or the closing pellet are in the form of a tip of or separate elements added on the reservoir.

The sleeve 42 has a substantially cylindrical tubular shape, extending along the second axis 38. Substantially at equal distance from its two axial ends, the sleeve 42 comprises an internal partition 54, that divides said sleeve into a first 56 and into a second 58 compartment, aligned according to the second axis 38.

The internal partition 54 is formed from one piece with an edge of the first end 46 of the reservoir 40. Said reservoir 40 extends partially into the first compartment 56 and emerges axially from said first compartment. The second internal volume 50 is open on the second compartment 58.

An internal wall of the first compartment 56 comprises a second removable means of assembly 60, such as a tapping. The second means 60 is able to cooperate with the first removable means of assembly 36 of the neck 32 in order to close the receptacle 20.

A free end of the first compartment 56 comprises a shoulder 61 that forms an external radial protrusion.

Figure 3:
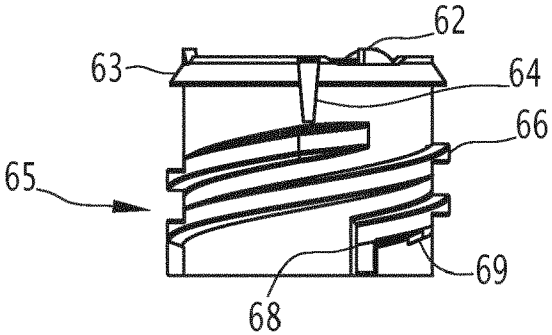

FIG. 3 shows a partial lateral view of the sleeve 42, on the second compartment 58. A free end of said second compartment 58 comprises at least one ratchet 62 which forms an axial protrusion. In the embodiment of FIGS. 1 and 3, said free end comprises three ratchets 62 arranged evenly around the second axis 38.

Said free end of the second compartment 58 further comprises a radial bulge 63, interrupted by notches 64. As shall be described hereinbelow, the ratchets 62 and the radial bulge 63 are intended for the assembly of the storage member 22 with the pressurization member 24.

An external wall of the second compartment 58 comprises a first means for guiding 65 for a displacement of the pressurization member 24 with respect to the storage member 22. Said first means for guiding 65 is configured to allow for a displacement having a component parallel to the second axis 38. In the embodiment of FIGS. 1 and 3, said first means for guiding 65 is of the threading type and allows for a helical displacement about said second axis 38.

More precisely, in the embodiment of FIGS. 1 and 3, the first means for guiding 65 comprises three helical ramps 66, substantially identical and arranged evenly about the second axis 38. Between a first end, close to the radial bulge 63, and a second end, close to the first compartment 56, the helical ramps 66 describe an angular trajectory preferable between 180° and 360° and more preferably close to 270°. Those skilled in the art will know how to adapt the angle and the pitch of the helical ramps in order to obtain the desired compression effect, with satisfactory ergonomics. The second end of each one of said ramps 66 is extended by an end of travel abutment 68, which extends axially in the direction of the first compartment 56.

Moreover, at least one of said ramps 66 is provided with an anti-unscrewing relief 69, in particular formed of a slope and a front surface with an anti-unscrewing abutment, of which the utility will be shown hereinbelow.

The first sealing skirt 44 comprises a bottom 70 and a cylindrical wall 72. The bottom 70 is formed from one piece with the internal partition 54 of the sleeve 42, about the first open end 46 of the reservoir 40. The cylindrical wall 72 extends into the second compartment 58 from the bottom 70, along the second axis 38. A free end of said cylindrical wall 72 is substantially coplanar with the radial bulge 63.

An annular space 74 is arranged in the second compartment 58 around the cylindrical wall 72.

The first sealing skirt 44 further comprises at least one rupture tab 76, which extends axially from the bottom 70 inside the cylindrical wall 72. In the embodiment of FIG. 1, the first sealing skirt 44 comprises three rupture tabs 76, arranged evenly about the second axis 38.

Figure 4:
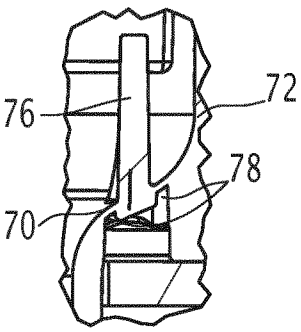
FIGS. 2, 3 and 4 are detailed views of a first element of the assembly of FIG. 1.

FIG. 4 shows a detailed view, as a cross section, of the first sealing skirt 44 on one of the rupture tabs 76.

The first sealing skirt 44 further comprises at least one second frangible zone 78, located on the bottom 70 around the or around each rupture tab 76. Said second frangible zone 78 is materialized by a local thinning of the wall of the bottom 70.

The pressurization member 24 extends along a third axis 79 and comprises a cover 80, a striker 82, a second sealing skirt 84 and rupture fins 86.

The cover 80 comprises a lateral wall 88, substantially tubular and arranged along the third axis 79. A first end of said lateral wall 88 is formed by an upper wall 90.

Figure 5:
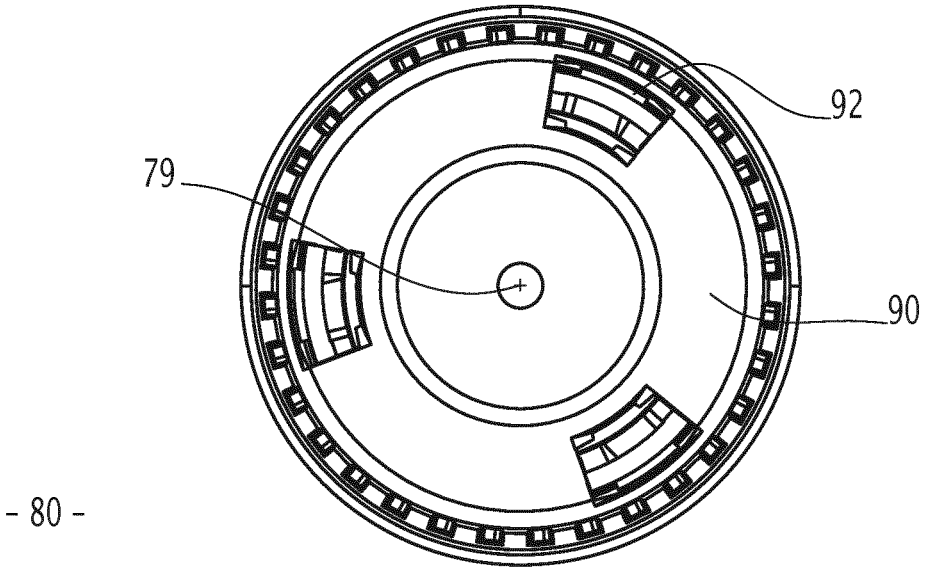
FIGS. 5 and 6 are detailed views of a second element of the assembly of FIG. 1.

FIG. 5 shows a top view of the cover 80. The upper wall 90 comprises at least one peripheral opening 92. In the embodiment of FIGS. 1 and 5, said upper wall comprises three peripheral openings 92 arranged evenly about the third axis 79. As shall be described hereinbelow, the peripheral openings 92 are intended for an elastic fitting with the ratchets 62 of the storage member 22.

The lateral wall 88 comprises three lugs 94 that form an internal protrusion. Each lug 94 is able to cooperate with a helical ramp 66 of the sleeve 42 for a displacement of the pressurization member 24 with respect to the storage member 22.

At the end of travel of the displacement of the pressurization member 24 with respect to the storage member 22, these lugs 94 are brought successively to cross the anti-unscrewing relief 69, passing on the slope and until extending beyond the front surface of the anti-unscrewing abutment, then to come into contact with the end of travel abutments 68.

The striker 82 extends along the third axis 79 and has a general tapered shape, between a base 96 and a tip 98. The base 96 is arranged inside the cover 80 and preferably formed from one piece with the upper wall 90. The tip 98 forms a protrusion outside the cover.

Figure 6:
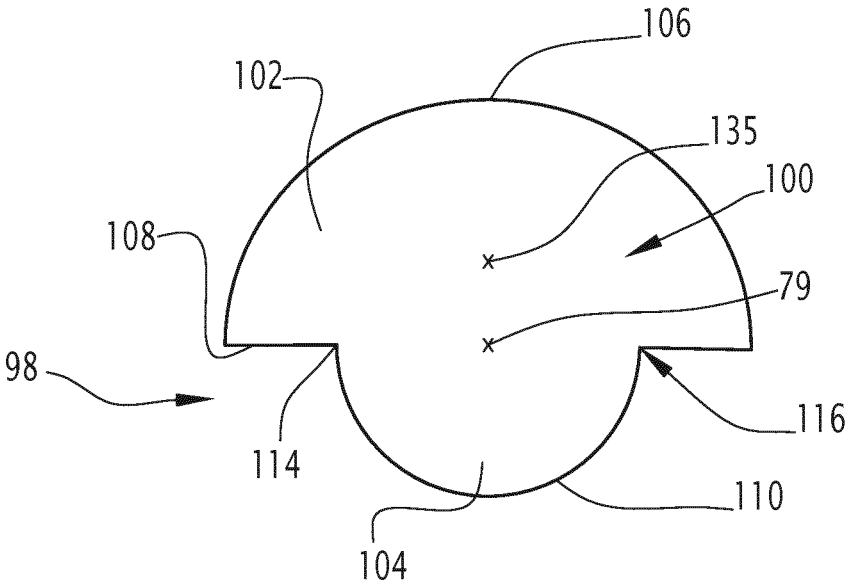

FIG. 6 shows a bottom view of the tip 98 of the striker 82. A front face 100 of said tip is substantially flat, perpendicular to the third axis 79. Said front face 100 comprises a first 102 and a second 104 parts, adjoining one another.

The first part 102 substantially has the shape of a portion of a disk with a first curved edge 106 and a straight edge 108. The first curved edge 106 has a first radius of curvature.

The second part 104 substantially has the shape of a portion of a disk with a second curved edge 110, having a second radius of curvature less than the first radius of curvature.

The second portion 104 adjoins the first portion 102 on the straight edge 108 and arranged in a centered manner on said edge. On either side of said second portion 104, a junction 114 of the second curved edge 110 and of the straight edge 108 has a concave shape.

Over at least one portion of its length forming a protrusion with respect to the cover 80, the striker 82 has a transversal section of a shape similar to the front face 100, the first and second radii of curvature varying over said length in accordance with the tapered shape of said striker. As such, a lateral surface of the striker 82 comprises two straight splines 116, extending in the continuity of each one of the concave junctions 114.

The second sealing skirt 84 comprises a cylindrical wall arranged around the striker 82, according to the third axis 79. Said second sealing skirt 84 extends from the upper wall 90 of the cover 80, to a free edge 117. The second sealing skirt 84 is able to be inserted in a sealed manner around the first sealing skirt 44 of the storage member 22.

An annular space 118 is defined inside the cover 80 around the second sealing skirt 84. The peripheral openings 92 of the upper wall 90 open on said annular space 118.

The rupture fins 86 have a substantially flat shape. Said fins extend axially from the upper wall 90 of the cover 80 and radially from the striker 82. In the embodiment of FIG. 1, the pressurization member 24 comprises three rupture fins 86 arranged evenly about the third axis 79. Each rupture fin 86 comprises a front edge 119, directed towards the tip 98 of the striker.

The distribution member 26 comprises a pipette 120 and a cap 122, integral with said pipette. Preferably, the distribution member 26 further comprises a member 124 for sampling a dose of the fluid composition using a pipette 120. The sampling member 124 comprises for example a push-button located on the cap 122.

An internal wall of the cap 122 comprises a third removable assembly means 126, such as a tapping. The third means 126 is able to cooperate with the first removable means of assembly 36 of the neck 32 in order to close the receptacle 20.

The method of mounting and using the assembly 10 shall now be described. The receptacle 20, the storage member 22, the pressurization member 24 and the distribution member 26 are manufactured separately. Each one of the first 28 and second 50 internal volumes is filled with a desired quantity, respectively of the first 12 and of the second 14 components.

The storage member 22 is then assembled to the receptacle 20 by introducing the reservoir 40 into the opening 30, then by screwing the sleeve 42 onto the neck 32. The receptacle 20 is as such closed by the storage member 22.

The storage member 22 and the pressurization member 24 are then assembled by introducing the tip 98 of the striker 82 into the first sealing skirt 44 and by bringing axially closer said storage member 22 and pressurization member 24, the second 38 and third 79 axes being confounded.

Said axial displacement leads to the putting into contact of lugs 94 of the cover 80 with the radial bulge 63 of the sleeve 42. The continuation of the axial force drives the lugs to cross said radial bulge which is elastically deformed on notches 64.

In parallel, the free edge 117 of the second sealing skirt 84 is inserted in the annular space 74 of the sleeve 42, around the first sealing skirt 44.

Figure 7:
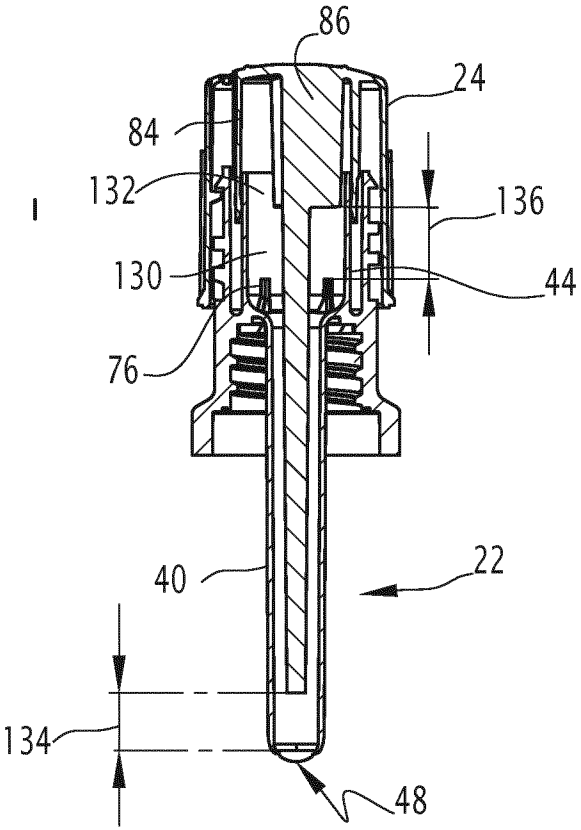

Each one of the lugs 94 of the cover 80 then arrives in contact with the first end of a helical ramp 66 of the sleeve 42. The storage member 22 and pressurization member 24 are then in a first configuration referred to as deployed, shown in FIG. 7.

In said deployed configuration, the first 44 and second 84 sealing skirts, inserted into one another, define a chamber 130 sealed from the air. A maximum volume 132 of said chamber 130 corresponds to the deployed configuration.

Moreover, in the deployed configuration, the striker 82 is partially received in the second volume 50 of the reservoir 40. The tip 98 of said striker is arranged at a first axial distance 134 from the second end 48 of said reservoir.

Moreover, in the deployed configuration, the rupture tabs 76 and the rupture fins 86 are arranged in the chamber 130. The front edge 119 of the rupture fins 86 is arranged at a second axial distance 136 from the rupture tabs 76, with said second axial distance being greater than the first axial distance 134.

The assembly 10 is marketed with the storage member 22 and pressurization member 24 in deployed configuration, the receptacle 20 being assembled to the storage member 22 and the distribution member 26 being presented separately. According to an alternative, the assembly 10 is marketed without a distribution member 26.

During the first use of the assembly 10, the user exerts a screwing movement on the cover 80 with respect to the receptacle 20 and to the storage member 22. As such, each lug 94 slides on an associated helical ramp 66, in the direction of the second end of said ramp. The free edge 117 of the second sealing skirt 84 comes closer to the bottom 70 of the first sealing skirt 44, decreasing the volume of the chamber 130. Due to its sealing to air, a pressure increases therefore inside said chamber 130, in fluid communication with the reservoir 40.

Figure 8:
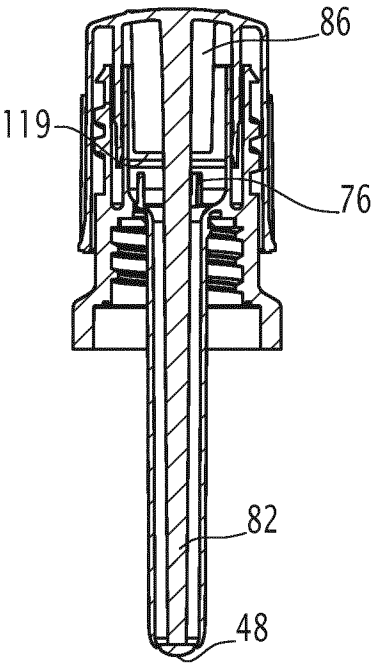
FIGS. 7, 8, 9 and 10 are cross-section views of said first and second elements, respectively in a first, a second, a third and a fourth configuration.

The screwing of the cover is continued until the putting into contact of the tip 98 of the striker 82 with the second end 48 of said reservoir. The storage member 212 and the pressurization member 24 are then in a second configuration, shown in FIG. 8. In said second configuration, the front edge 119 of the rupture fins 86 is still at a distance from the rupture tabs 76.

The first distance 134, in deployed configuration, between the striker 82 and the second end 48 of the reservoir, is defined in such a way that the second configuration corresponds to an appropriate overpressure in the chamber 130, as described hereinafter.

The continuation of the screwing leads to a total or partial tearing of the circular groove 52 of the second end 48, in contact with the front face 100 of the tip 98.

In particular, the shape of the front face is configured to concentrate the axial force on the first curved edge 106. Across from the second curved edge 110, the groove 52 is partially not torn.

More precisely, and as can be seen in FIG. 6, the front face 100 is not of symmetrical revolution about the third axis 79. In other words, a barycenter 135 of the front face 100 is not located on the third axis 79 and is located radially offset with respect to the third axis 79, here on the side of the portion of the disk with the largest diameter (or the largest radius of curvature) 102.

As such, when this front face 100 comes into contact with an interior face 137 of the closing pellet 53, of which the barycenter is located on the second axis 38 (here, the interior face 137 of the closing pellet 53 is circular and has a symmetry of revolution about the second axis 38), with the second and third axes 38, 79 aligned, the barycenter of the front face 100 is radially offset with respect to the barycenter of the closing pellet 53.

Due to this offset, the circular groove 52 tends to be torn preferably on the side of the barycenter of the front face 100, here on the side of the portion of the disk with the largest diameter (or with the largest radius of curvature) 102 of the front face 100 and to remain at least partially intact on the opposite side, here on the side of the portion of the disk with the smallest diameter (or with the smallest radius of curvature) 104 of the front face 100.

In the case where the tear of the groove 52 is partial, the closing pellet 53 remains connected to the rest of the reservoir 40 by a hinge 139, as such preventing falling to the bottom of the receptacle 20. This effect is in particular better controlled in the case where the circular groove 52 is not closed, as described hereinabove, with the angular portion in which the groove does not extend, cleverly placed, acting as a hinge 139 for the closing pellet.

The rupture of the circular groove 52 leads to the opening of the second end 48, according to a shape corresponding substantially to, that of the closing pellet 53. This opening, combined with the overpressure in the chamber 130, leads to an expulsion of the second composition 14 outside the reservoir 40, by the second end 48. The splines 116 formed on the striker 82 favor the flow towards the outside of the second composition 14.

The expulsion under pressure of the second composition 14 in the first composition 12 advantageously produces a visual effect linked to the difference in color and/or appearance between said first and second compositions. The transparency of the receptacle 20 advantageously makes it possible to enhance the value of this visual effect.

Moreover, the expulsion under pressure contributes to the mixture of the first 12 and second 14 compositions on the first volume 28, in order to form the third composition 16.

Figure 9:
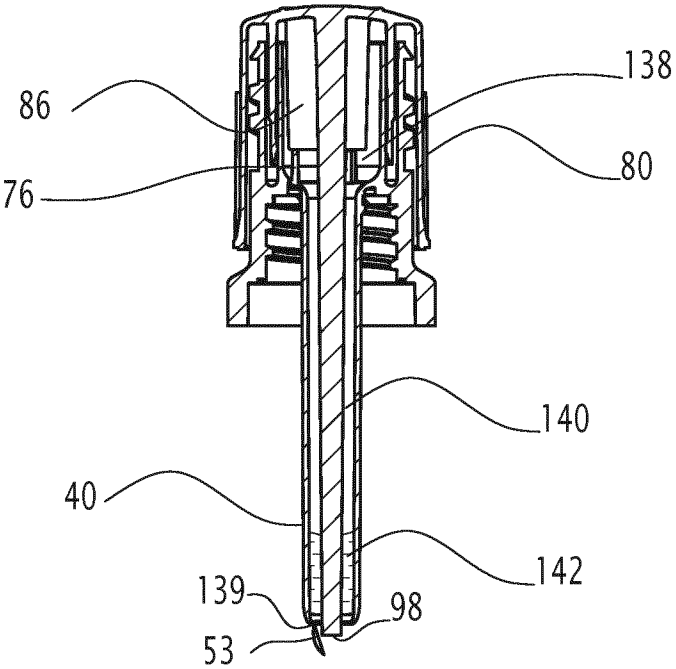

The screwing of the cover is continued until the putting across of the front edge 119 of the rupture fins 86 with one end of the rupture tabs 76. The storage member 22 and the pressurization member 24 are then in a third configuration, shown in FIG. 9, which corresponds to an intermediate volume 138 of the chamber 130. In the third configuration, the tip 98 of the striker 82 forms a protrusion with respect to the second end 48 of the reservoir 40.

The striker 82 occupies a portion of the second volume 50 of the reservoir 40, leaving free an annular space 140. Said annular space is of a low radial thickness, which leads to a capillary retention of a residue 142 of the second composition 14 to the second end 48 of the reservoir 40.

The screwing of the cover is continues until the lugs 94 reach the second end of the helical ramps 66. In doing this, the lugs 94 are displaced to the shoulder 61, by cooperating with the ramps 66 until the screwing end of travel abutment 68, after having exceeded the anti-unscrewing relief 69 which then prohibits an unscrewing of the cover 80.

During this portion of screwing, the rupture fins 86 come into contact with the rupture tabs 76 and rotate about the axis of rotation 79, exerting an force on said tabs. Said force drives the rupture tabs 76 to be deformed, in particular in torsion and/or bending, and/or to pivot, in such a way as to cause a partial tear of at least one second frangible zone 78. The chamber 130 is then open to the air on the first compartment 56 of the sleeve 42.

The ratchets 62 of the sleeve 42 then come to fit elastically in the peripheral openings 92 of the cover 80. The storage member 22 and the pressurization member 24 are then locked to one another in a fourth configuration referred to as compact, shown in FIG. 10. A minimum volume 144 of the chamber 130 corresponds to said compact configuration.

The user then unscrews from the neck 32 the storage member 22/pressurization member 24 assembly in order to open the receptacle 20. The opening of said receptacle leads to an intake of air into the chamber 130 by the open frangible zones 78. This air intake facilitates a capillary flow of the residue 142 of the second composition 14 by the second end 48 of the reservoir.

Experimentally, it was observed that the setting in place of an air intake in the chamber 130 makes it possible to pass from 70% to 95% a recovery rate of the second composition 14 in the receptacle 20. The proportion of the second composition 14 in the third composition 16 is therefore more compliant with the desired value.

After dissociation of the receptacle 20, the storage member 22/pressurization member 24 can be discarded. The user samples and uses a dose of the third composition 16 using the pipette 120 of the distribution member 26. After use, the cap 122 is assembled to the neck 32 for the closing and the storage of the receptacle 20.

The invention claimed is:

1. A packaging and distribution assembly for a fluid product, comprising:

a receptacle able to receive a first fluid composition, said receptacle comprising an opening provided with first removable means of assembly;

a storage member, comprising:

second removable means of assembly, able to cooperate with the first removable means of assembly for closing the receptacle; and a tubular reservoir, integral with said second removable means of assembly and able to receive a second fluid composition, said tubular reservoir comprising a closed end, configured to be arranged inside the receptacle in an assembled configuration of said receptacle with said storage member; and a pressurization member of the tubular reservoir;

characterized in that the storage member and the pressurization member comprise respectively a first and a second sealing skirts, said first and second sealing skirts being configured to be inserted one in the other in a sealed manner, in such a way as to define a closed chamber in communication with the tubular reservoir, to be displaced axially one in relation to the other in such a way as to decrease the volume of said closed chamber.

2. The packaging and distribution assembly according to claim 1, wherein the storage member and pressurization member comprise respectively first and second means for guiding for a helical displacement of said pressurization member with respect to said storage member, said helical displacement being able to decrease a volume of the closed chamber.

3. The packaging and distribution assembly according to claim 1, wherein the storage member and pressurization member comprise respectively the first and second means of elastic fitting, able to block said storage and pressurization members in a compact configuration corresponding to a minimum volume of the closed chamber.

4. The packaging and distribution assembly according to claim 1, wherein the pressurization member comprises a striker of elongated shape, able to be received in the tubular reservoir of the storage member, said striker being configured in such a way that, in a deployed configuration of the storage and pressurization members, corresponding to a maximum volume of the closed chamber, an end face of said striker is arranged at distance from the closed end of said tubular reservoir, said end face being able to strike said closed end during or at the end of the axial displacement of the first and second sealing skirts with respect to one another.

5. The packaging and distribution assembly according to claim 4, wherein the storage member and pressurization member comprise respectively the first and second means of elastic fitting, able to block said storage and pressurization members in a compact configuration corresponding to a minimum volume of the closed chamber, and wherein, in the compact configuration of the storage members and pressurization members, the end face of the striker forms an axial protrusion with respect to the tubular reservoir.

6. The packaging and distribution assembly according to claim 4, wherein a lateral surface of the striker comprises at least one spline ending at the end face.

7. The packaging and distribution assembly according to claim 6, wherein a transversal section of the striker comprises a first and a second adjoining portions, with each one of said portions formed from a portion of disk having respectively a first and a second different radii of curvature, with a junction between said first and second portions defining the at least one spline of the lateral surface.

8. The packaging and distribution assembly according to claim 1, further comprising a sampling member able to sample and/or distribute a dose of fluid composition received in the receptacle, said sampling member comprising third removable means of assembly, able to cooperate with the first removable means of assembly of the opening of the receptacle.

9. A method for using a packaging and distribution assembly according to claim 4, comprising the following steps:

mounting of the storage member and of the receptacle in assembled configuration, the receptacle and the tubular reservoir respectively receiving the first and the second fluid compositions; then mounting of the storage member and of the pressurization member in deployed configuration; then axial displacement of the pressurization member with respect to the storage member in such a way as to reduce the volume of the closed chamber; then percussion of the second end of the reservoir by the end face of the striker and expulsion under pressure of the first fluid composition into the second fluid composition.

10. The method for using according to claim 9, wherein the packaging and distribution assembly further comprises a sampling member able to sample and/or distribute a dose of fluid composition received in the receptacle, said sampling member comprising third removable means of assembly, able to cooperate with the first removable means of assembly of the opening of the receptacle, the method then comprising the following steps:

disassembly of the storage member and of the receptacle; then removable assembly of the sampling member with the receptacle.

11. The packaging and distribution assembly according to claim 2, wherein the storage member and pressurization member comprise respectively the first and second means of elastic fitting, able to block said storage and pressurization members in a compact configuration corresponding to a minimum volume of the closed chamber.

12. The packaging and distribution assembly according to claim 2, wherein the pressurization member comprises a striker of elongated shape, able to be received in the tubular reservoir of the storage member, said striker being configured in such a way that, in a deployed configuration of the storage and pressurization members, corresponding to a maximum volume of the closed chamber, an end face of said striker is arranged at distance from the closed end of said tubular reservoir, said end face being able to strike said closed end during or at the end of the axial displacement of the first and second sealing skirts with respect to one another.

13. The packaging and distribution assembly according to claim 3, wherein the pressurization member comprises a striker of elongated shape, able to be received in the tubular reservoir of the storage member, said striker being configured in such a way that, in a deployed configuration of the storage and pressurization members, corresponding to a maximum volume of the closed chamber, an end face of said striker is arranged at distance from the closed end of said tubular reservoir, said end face being able to strike said closed end during or at the end of the axial displacement of the first and second sealing skirts with respect to one another.

14. The packaging and distribution assembly according to claim 5, wherein a lateral surface of the striker comprises at least one spline ending at the end face.

15. The packaging and distribution assembly according claim 2, further comprising a sampling member able to sample and/or distribute a dose of fluid composition received in the receptacle, said sampling member comprising third removable means of assembly, able to cooperate with the first removable means of assembly of the opening of the receptacle.

16. The packaging and distribution assembly according claim 3, further comprising a sampling member able to sample and/or distribute a dose of fluid composition received in the receptacle, said sampling member comprising third removable means of assembly, able to cooperate with the first removable means of assembly of the opening of the receptacle.

17. The packaging and distribution assembly according claim 4, further comprising a sampling member able to sample and/or distribute a dose of fluid composition received in the receptacle, said sampling member comprising third removable means of assembly, able to cooperate with the first removable means of assembly of the opening of the receptacle.

18. The packaging and distribution assembly according claim 5, further comprising a sampling member able to sample and/or distribute a dose of fluid composition received in the receptacle, said sampling member comprising third removable means of assembly, able to cooperate with the first removable means of assembly of the opening of the receptacle.

19. The packaging and distribution assembly according claim 6, further comprising a sampling member able to sample and/or distribute a dose of fluid composition received in the receptacle, said sampling member comprising third removable means of assembly, able to cooperate with the first removable means of assembly of the opening of the receptacle.

20. The packaging and distribution assembly according claim 7, further comprising a sampling member able to sample and/or distribute a dose of fluid composition received in the receptacle, said sampling member comprising third removable means of assembly, able to cooperate with the first removable means of assembly of the opening of the receptacle.

* * * * *